United States Patent [19]

Steinman et al.

[11] Patent Number: 4,723,757

[45] Date of Patent: Feb. 9, 1988

[54] RATCHET-WHEEL-PAWL ASSEMBLY AND RELEASE MEANS FOR PORTABLE WINCH

[75] Inventors: Gerald W. Steinman; Lonnie M. Smith, both of St. Louis, Mo.

[73] Assignee: Durbin-Durco, Inc., St. Louis, Mo.

[21] Appl. No.: 850,513

[22] Filed: Apr. 11, 1986

[51] Int. Cl.[4] ..... B66D 1/14; B66D 5/32

[52] U.S. Cl. ..... 254/369; 254/376

[58] Field of Search ..... 254/217, 218, 223, 369, 254/376

[56] References Cited

U.S. PATENT DOCUMENTS

| | | | |
|---|---|---|---|
| 2,669,426 | 2/1954 | Anglemyer | 254/369 |
| 2,890,857 | 6/1959 | Hoffman | 254/369 |
| 3,003,359 | 10/1961 | Maasdam | 254/369 X |
| 3,524,626 | 8/1970 | Pomagalski et al. | 254/369 |
| 3,724,816 | 4/1973 | Cain et al. | 254/369 |
| 3,727,886 | 4/1973 | Cain | 254/369 |
| 3,985,342 | 10/1976 | Denman | 254/369 X |
| 4,199,134 | 4/1980 | Kerber et al. | 254/369 |

*Primary Examiner*—Stuart S. Levy
*Assistant Examiner*—Joseph J. Hail, III
*Attorney, Agent, or Firm*—Paul M. Denk

[57] ABSTRACT

A portable winch incorporating at one end a mechanism for providing its suspension from a stabilized support, said frame member having a cable winding drum provided therein, and a handle lever operatively associated with the drum and disposing a ratchet pawl for engagement with the ratchet wheel of the drum, in order to provide for a winding of the cable upon the drum, for lifting or supporting of a load, or for providing its gradual release therefrom. The ratchet pawl of the handle lever capable of manipulating into two positions, one providing for its permanent engagement with the ratchet wheel teeth, or in the alternative, through a maneuvering of its supporting spring, can be shifted out of engagement with the ratchet wheel teeth. A stop pawl operatively associates with the frame member and normally in engagement with the ratchet wheel, to maintain it in its wound position during manipulation of the handle lever. The stop pawl capable of being released from such engagement through pressure exerted upon its integral stem, to provide for a rapid unwinding of the drum wound cable, and its supported load, or through an upward exertion of the handle lever to its fullest extent, its ratchet pawl engages with and biases against a release cam, to force a temporary release of the stop pawl from the ratchet wheel, to provide for an incremental unwinding of the cable from its drum, through repeat movements of the handle lever and its ratchet pawl against the release cam of the stop pawl for this portable winch.

2 Claims, 7 Drawing Figures

RATCHET-WHEEL-PAWL ASSEMBLY AND RELEASE MEANS FOR PORTABLE WINCH

BACKGROUND OF THE INVENTION

This invention relates generally to a portable winch, and more specifically to release means that operate in conjunction with the functioning of the winch, and provide adequate clearance for unwinding of any cable from the winch drum either continuously, or incrementally, during its application.

Various styles of portable winches are available in the prior art, and which are generally useful for exerting force through its associated cable for either pulling or lifting of a load. Winches of standard construction have usually incorporated a frame means supporting a drum wound cable, the drum incorporating with it a ratchet, or ratchet wheel, which is engaged by the ratchet pawl of a handle lever which is useful for turning of the ratchet wheel in one direction, normally that which provides for a winding and exertion of force through its associated cable for performing the foregoing stated functions. Obviously, as is also well known, a stop pawl or dog means is normally employed for preventing a return of the ratchet wheel, or an untimely unwinding of the drum cable, during the performance of this lifting or pulling function.

Examples of this type of portable winch is shown in the earlier Durbin, U.S. Pat. No. 4,199,134, disclosing such named operative components. It is to be noted, though, that various other operative mechanisms are disclosed in this earlier United States patent, and which includes structural means for effectively incorporating its coil spring into disposition selectively either to bias its ratchet dog into an operative or inoperative position. It must be stated, though, that the subject matter of this earlier patent is owned by the assignee, or subsidiary thereof, having rights to the invention of this current application.

Various other type of power unit devices, generally of the winch category, and incorporating a cable winding drum means, is shown in the earlier Anglemyer, U.S. Pat No. 2,669,426. This device does incorporate or describe the usage of a spring mechanism for biasing its feed pawl out of a ratchet engaging position.

The Hoffman, U.S. Pat. No. 2,890,857, discloses another type of portable winch, having the standard operating components including its drum supported cable, a handle or lever, and the various operative feed and stop pawls. In addition, this winch does disclose the application of a reversing cam that apparently permits the reversing movement of the ratchet and drum under the control of its feed pawl. And, apparently through this operation the ratchet wheel is allowed to reverse to the extent of one tooth.

Regardless of the foregoing, the subject matter of this current application is to provide a portable winch which incorporates means to retain its ratchet pawl into engagement with a ratchet wheel, as when its spring means is shifted into one position, while on the other hand, when the spring means is shifted or pivoted into a second position, provides for a more permanent disengagement of said pawl from the subject wheel. Thus, in the former position, the object of this invention is achieved by providing a permanent engagement of the ratchet pawl with its wheel, in order that the lever may be cranked to provide a pull or lifting of any load as transmitted through its cable, but that when the load handling condition has been achieved and a release is required, the pawl may be held in a location of more permanent disengagement from its ratchet wheel.

Another object of this invention is to provide means operatively associated with a ratchet pawl and its holding spring that can be easily manipulated by the operator to provide for enagement, or in the alternative, disengagement, of a ratchet or feed pawl from its ratchet wheel.

Still another object of this invention is to provide means for simplifying the unwinding of a ratchet wheel, and its drum held cable, incrementally, so that its suspended load can be gradually lowered to a supporting surface, or the ground.

Another object of this invention is to provide an integrated structure of the stop pawl or detent for the ratchet wheel of a portable winch and which structure can be manipulated for either fixing a winch drum cable supported load at a particular position, release its stop pawl for a rapid lowering of its suspended or held load, or provide for an incremental and gradual lowering or loosening of any suspended load.

Another object of this invention is to provide a winch assembly which is fabricated from a minimum of components, all of which are structurally integrated and connected together to provide a unified portable winch, yet is capable of performing the variety of winch operations as previously alluded to, through a minimum of effort and exertion on the part of its operator.

These and other objects will become more apparent to those skilled in the art upon reviewing the summary of this invention, and upon undertaking a study of the description of its preferred embodiment, in view of the drawings.

SUMMARY OF THE INVENTION

This invention contemplates the construction of a winch, and preferably a portable winch, of the type that is normally used for holding a load in suspension, or in the alternative, which is useful for connecting with some structure or load that requires a forced movement by means of a tensioned cable(s). More specifically, the portable winch of this invention incorporates the usual ratchet-wheel-pawl assembly, which includes a frame member, having an axle therein, a drum supported by the axle, the drum containing a supply of wound cable, and which is capable of being unwound, as during usage of this development, with a ratchet wheel carried by the drum, and which is subject to engagement, around any one of its peripheral gears or teeth, by a ratchet pawl pivotally supported by the handle lever for the winch. The frame member of the winch incorporates a stop pawl or detent, that normally engages with the ratchet wheel teeth for holding the cable drum at its manipulated position, and to which it has been tightened while maneuvering a load, either in suspension, or for movement.

The handle lever incorporates a pair of lever arms, or bifuracated arms, across which a first shaft is located, with the ratchet pawl being pivotally mounted thereon, and being biased by a spring either into engagement with the wheel gears, or through manipulation of its associated torsional spring, may be pivoted to more permanent disposition out of engagement with the ratchet wheel.

The stop pawl, or detent, of this winch is supported by the frame member, and which frame member is fabricated from a pair of side frames, also incorporating a shaft, or second shaft, there across. The stop pawl is pivotally mounted upon said shaft, approximately in alignment with the gears of the ratchet wheel, with said pawl normally being biased into engagement with the said ratchet wheel through the association of a spring means, that is likewise mounted upon said second shaft and normally biases said detent into gear engagement. The stop ratchet incorporates a detent means, that, as previously explained, is normally arranged in engagement with the ratchet gears. In addition, the detent incorporates said pair of flanges, generally arranged perpendicularly therewith, with each flange having an aperture therethrough, and which pivotally mount the stop pawl upon the said second shaft. A release means in the form of a stem is integrally formed with the detent portion, and extends outwardly of the frame member, and is readily available for urging by the operator for effecting a pivoting of the stop pawl, to achieve this disengagement from the teeth of the ratchet wheel, as when a rapid unwinding of cable is required or desired.

In the alternative, also included pivotally mounting upon the said second shaft is a release cam, generally formed as a pair of flanges that are shaped having an intermediate curvature to provide for its mounting upon the said second shaft, with one of the flanges disposed for contacting with the detent portion of the stop pawl, and to urge it out of engagement with the ratchet wheel, when the other flange is contacted under force by the ratchet pawl during manipulation to the one extreme of the handle lever. Thus, when the portable winch may be in a load supporting position, as for example when suspending some type of a load whether it be a mechanical structure, as when used in the machine shop, a pallet full of components, as in a manufacturing plant, or even as remotely utilized, as by illustration, by the hunter, as he may desire to suspend a just shot deer and position it vertically for dressing. These are just diverse examples.

As can be understood, there are a wide variety of uses for a portable winch of this nature, and which may require a gradual or incremental release of its load supporting cable, and thus its load, when it is desired to disengage the winch from its load connection and support. In any event, when this type of release in the usage and application of the portable winch of this invention is required, the ratchet pawl will be pivoted into its disengaging position from the ratchet wheel, since the ratchet wheel will have already been turned sufficient revolutions to provide for the support of the load at its previous desired location. But, when any processing of the load is completed, and it is required to release it, gradually, without impact, to a supporting surface, the stop pawl will be repeatedly contacted to incrementally release the ratchet wheel a gear at a time.

BRIEF DESCRIPTION OF THE DRAWINGS

In referring to the drawings, FIG. 1 provides a side view of the portable winch of this invention as suspended vertically as during application.

DESCRIPTION OF THE PREFERRED EMBODIMENT

Figure 1:
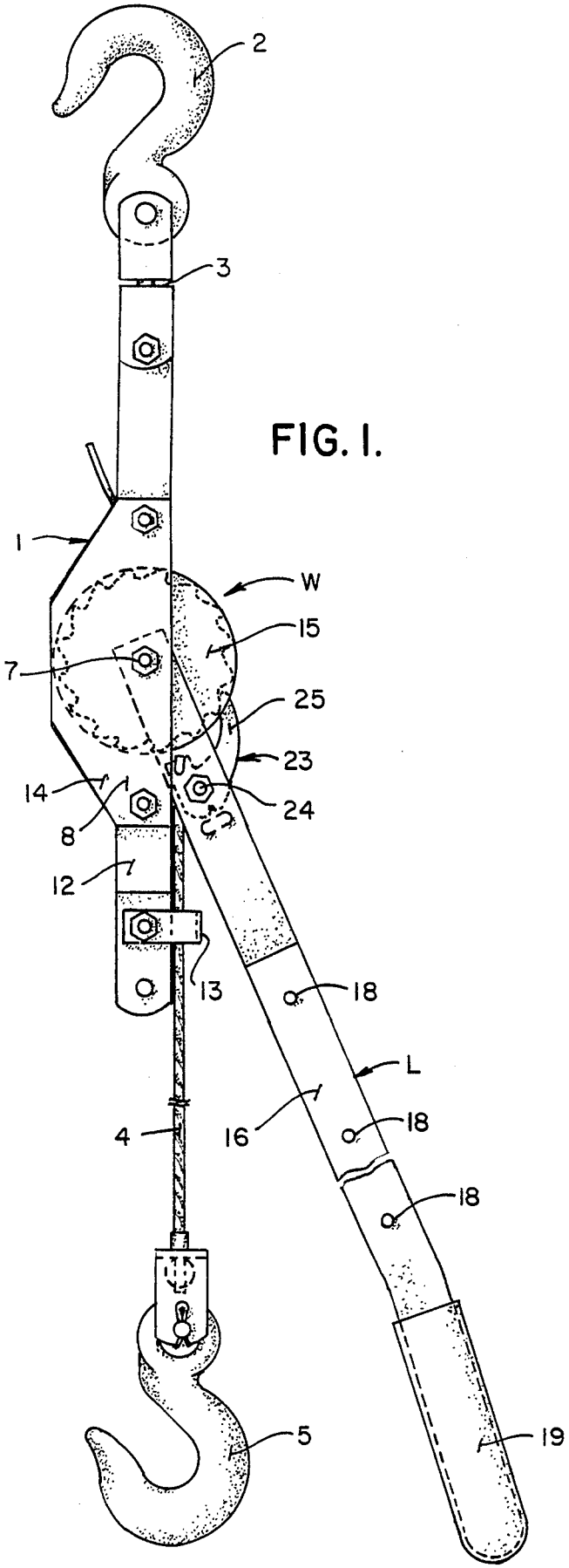
Figure 2:
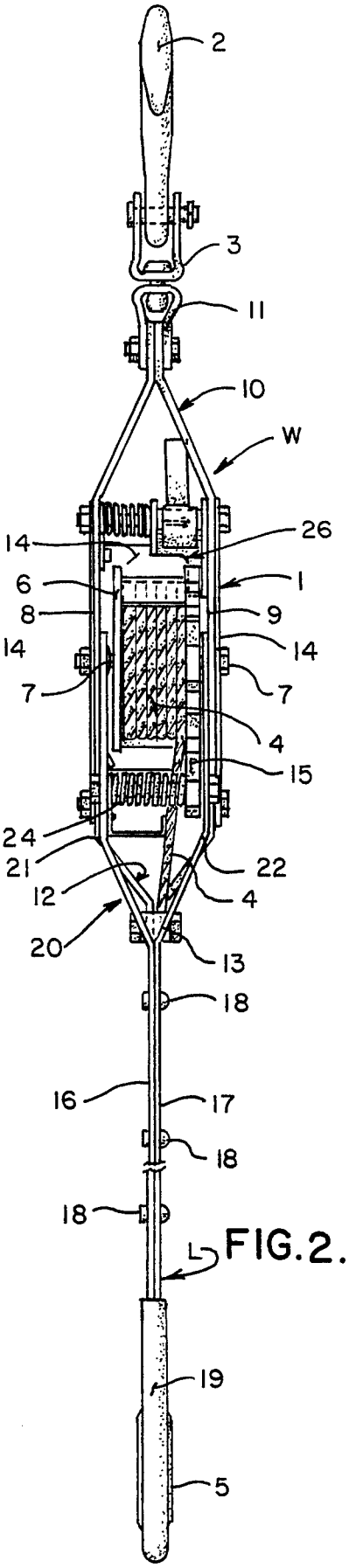
FIG. 2 is a front view of the portable winch shown in FIG. 1.

In referring to the drawings, and in particular FIGS. 1 and 2, therein is shown the portable winch W of this invention. The structure incorporates a frame member 1 supporting at its upper end a hook 2 which may be mounted by means of a swivel joint 3 to said frame member 1. At the opposite or lower end of the portable winch, there is provided the cable 4 suspending a further fastening means, such as the hook 5, for use for suspending or pulling a connected load, as during application of the device. The cable 4 is generally wound upon a drum, as at 6, which is supported by means of axle 7 within the frame member 1. The frame member is fabricated of a pair of side frames 8 and 9, which are formed or bent into a yoke, as at its upper end, as at 10, for connection with the clip 11 that engages with the swivel 3. The downward end of the side frames 8 and 9 likewise converge into the form of a vee shape, or yoke, or the like, as at 12, and support a guide 13, that conveniently aligns and maintains the suspended cable 4, as can be seen. A cover plate, as at 14, connects with each of the side frames 8 and 9, and entirely surrounds the back side of the frame member 1, to shield it externally.

The drum 6, which is used as windlass for holding the wound cable 4, is formed having integrally structured along one side a ratchet wheel 15, containing the peripheral gears or teeth T, and which wheel is subject to engagement with various pawls, as to be subsequently described, useful for urging the winding of the cable upon the said drum, and for holding it in its wound condition.

Figure 5:
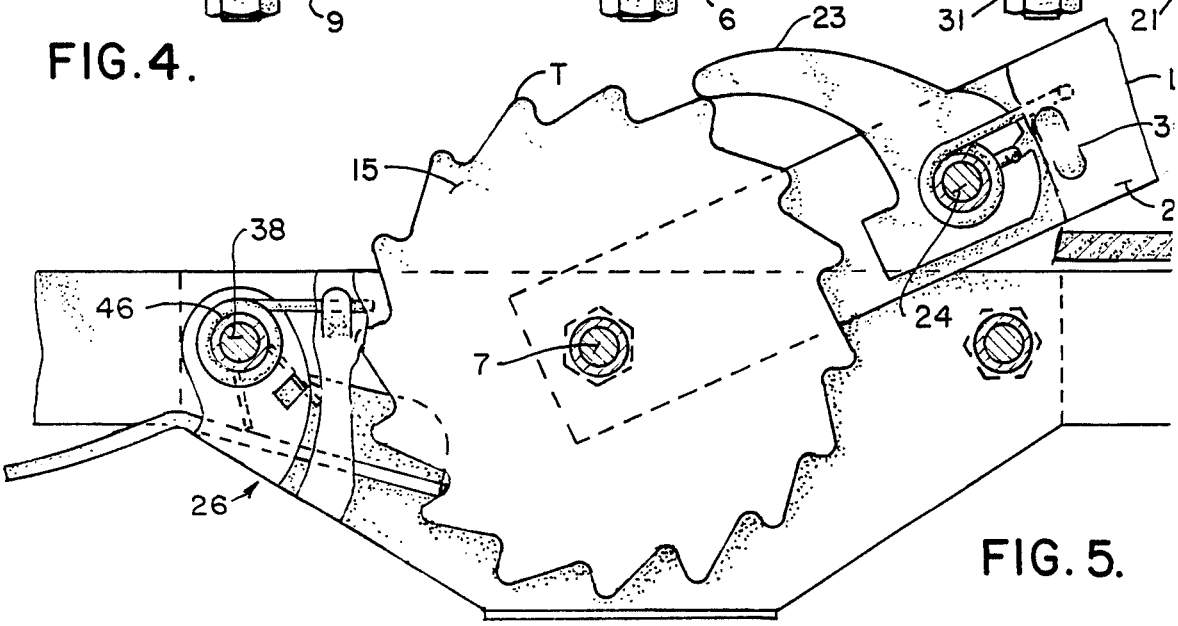
FIG. 5 is a similar view of the invention as disclosed in FIG. 3, showing the ratchet pawl during a return of its hand lever, and the stop pawl in the position of engagement and holding of the ratchet wheel.

Operatively associated with the frame member 1 is the handle lever L of the winch structure. This lever is generally fabricated along the lines of that disclosed in the prior art, and in this particular instance, incorporates a pair of a length of bar members 16 and 17, which are secured together into juxtaposition along a substantial portion of their length by means of the fasteners, such as the rivets 18, as shown. The bar members are furcated at their end opposite to the location of the hand grip 19, with said bifurcated end being generally disclosed at 20. This portion of the handle lever is formed of a pair of integral arms of the lever, as at 21 and 22, and which are bent to be spaced apart a sufficient distance to provide for their mounting upon the axle 7, just inwardly of the side frames 8 and 9, as can be seen. As can be noted also in FIG. 1, there is pivotally mounted upon the spaced apart arms a ratchet pawl 23, being mounted into position by means of a shaft 24 that extends between the said arms, as disclosed. The ratchet pawl 23 likewise pivotally mounts upon said shaft 24, and in addition, has an elongated portion, as at 25, that extends upwardly for engagement with the teeth of the ratchet wheel 15, as shown in FIG. 5. As can be understood from the operations of a winch of this design, as the handle lever L is pivoted downwardly, into the position as shown in FIG. 1, the ratchet pawl 23 simply overrides the various teeth of the ratchet wheel 15. But, in the alternative, as the handle lever L is pivoted upwardly, about the axle 7, its ratchet pawl 23 engages with the teeth of the wheel 15, and thereby turns the drum 6 for providing a rewinding of the cable upon the drum 6 each time the lever is rotated upwardly, as during a wind up of the cable 4, there is provided a stop pawl 26 that is maintained in engagement with the gears or teeth of the ratchet wheel 15, and prevents its unwinding, as the handle lever L is pivoted once again or returned downwardly, in preparation for its repositioning for its upward lift in a further cycle when rewinding of the cable 4 about the drum 6.

The essence of this invention are the modifications that are made to the ratchet pawl 23, and the stop pawl 26, and their cooperative functioning together to achieve the objects and purposes of this invention, as previously explained.

Figure 3:
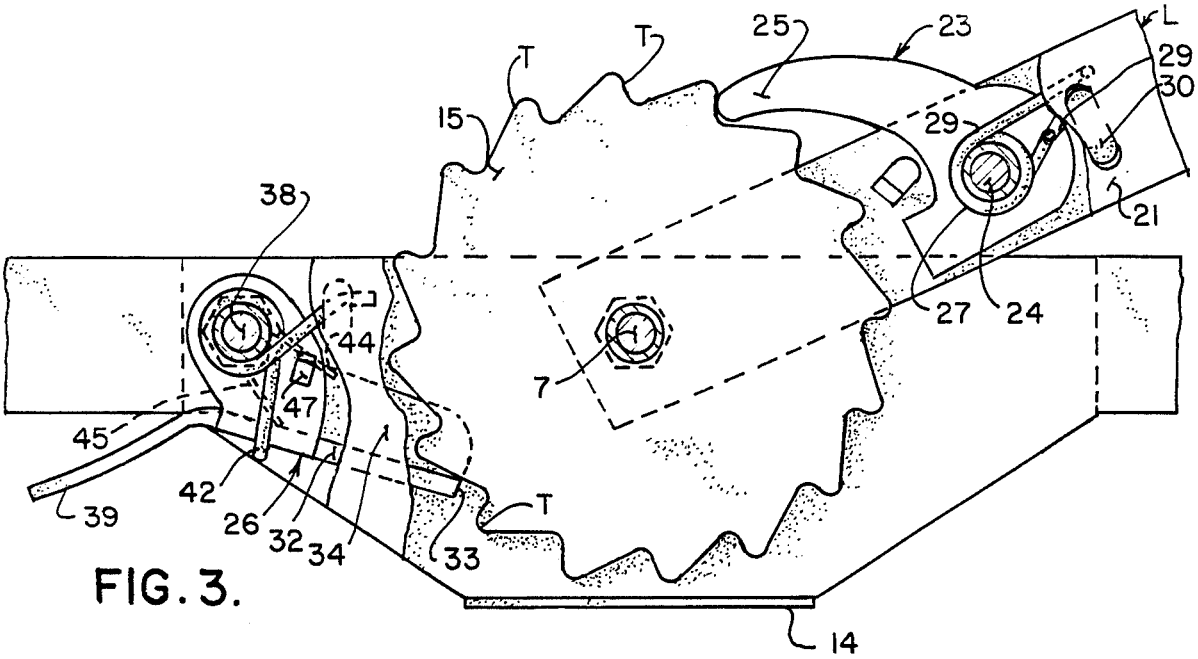
FIG. 3 is a partial side view of the portable winch, with a portion of the side frame removed, to expose the ratchet wheel, the ratchet pawl, and the stop pawl of the assembly.
Figure 4:
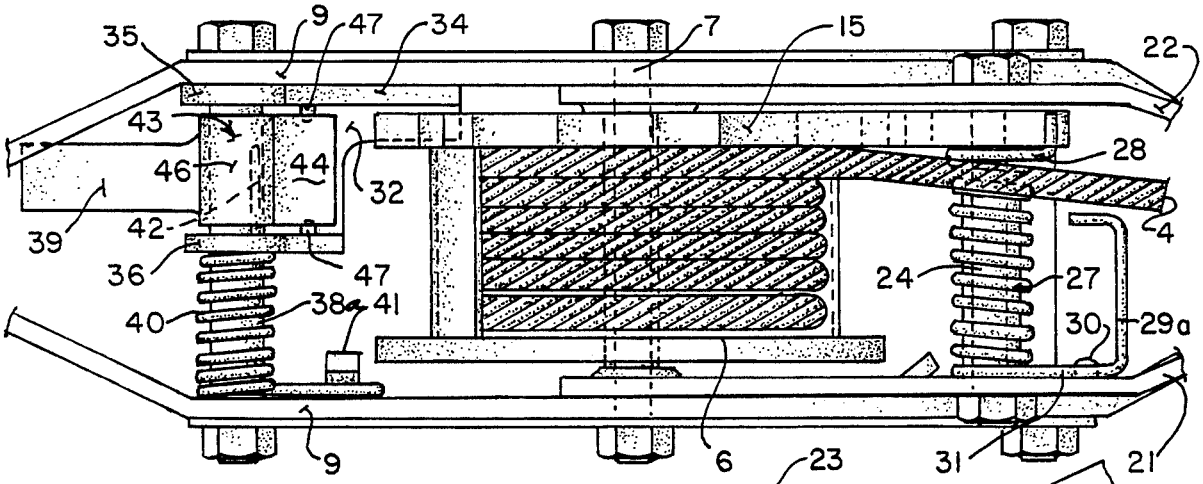
FIG. 4 is a top view of FIG. 3.
Figure 6:
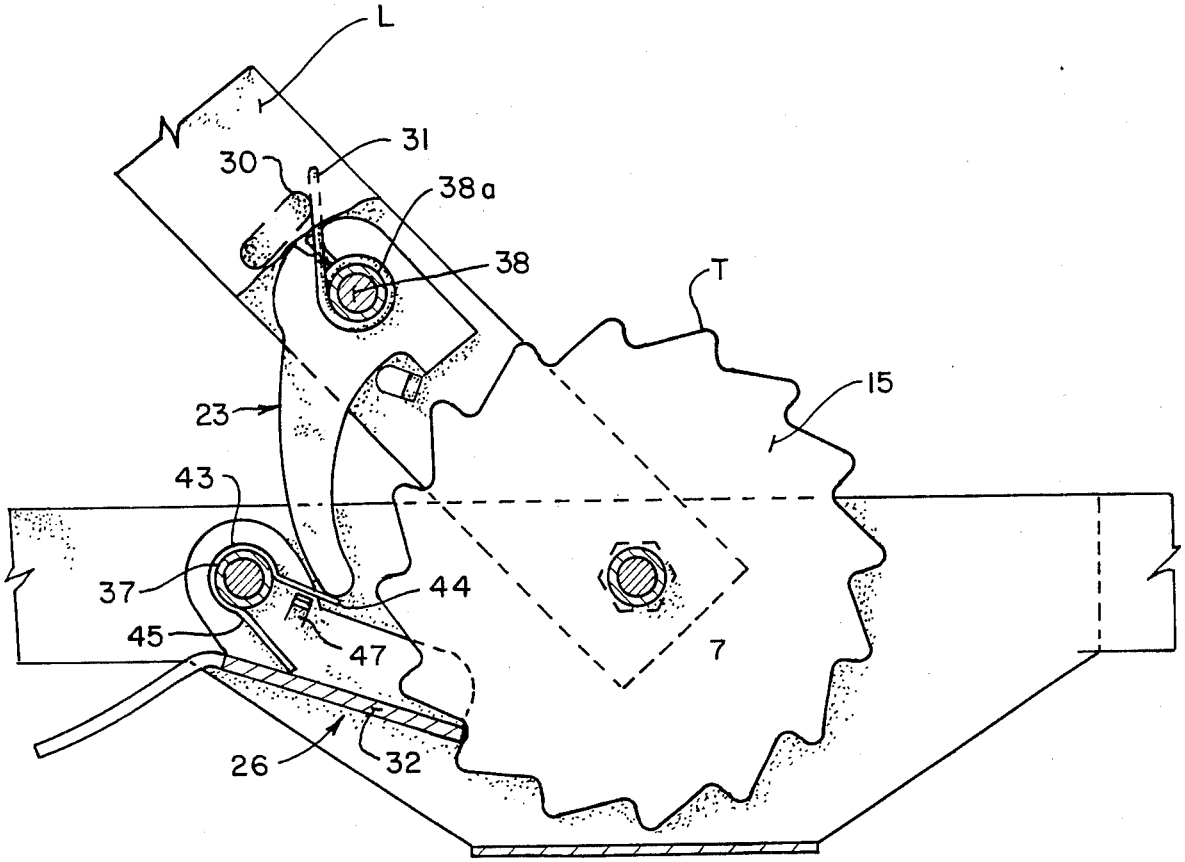
FIG. 6 is a similar side view to that of FIG. 5 but showing the ratchet pawl pivoted to its position of non-engagement with the ratchet wheel, and being maneuvered into position for engagement with the stop pawl in preparation for incremental release of the ratchet wheel and unwinding of cable.
Figure 7:
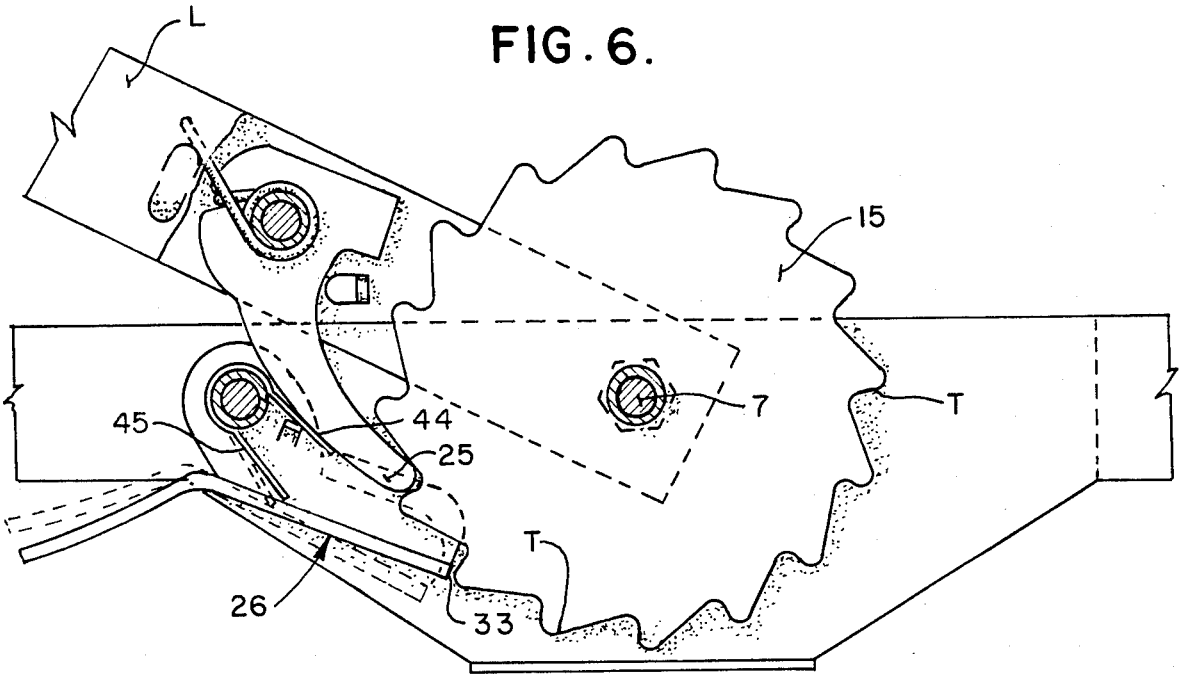
FIG. 7 discloses a similar view to that of FIG. 6, but with the handle lever fully pivoted upwardly and into position where the release cam under pressure from the ratchet pawl temporarily disengages from the ratchet wheel to provide for incremental release of cable from the portable winch.

As can also be seen in the FIGS. 3 through 7, the ratchet pawl 23 is mounted with the torsion spring 27 upon the shaft 24 extending between the arms 21 and 22 of the handle lever L. The torsion spring 27, at one end, is bent, as at 28, for engagement within a slot 29 provided proximate the back surface of the ratchet pawl 23, and is fixed with respect thereto. The opposite end of the torsion spring 27 is likewise bent, into the configuration as shown at **29*a*, and provides an extended stem-like member that is conveniently disposed for grasping by the fingers and to provide for its manipulation in the manner and for the following purpose. Provided upon one of the arms of the handle lever L, and more spcecifically upon that arm 21, is a bosslike portion 30 that extends inwardly from the interior surface of the arm 21, particularly as can be noted in FIG. 4. The extending portion 29*a*, or more specifically that segment 31, of the torsion spring 27 is disposed for arrangement and disposition to either side of the boss means 30. Then the extending portion 29*a* of the spring segment is arranged above the boss 30, as shown in FIG. 3, the torsion spring is further turned in a manner that urges the ratchet pawl 23 into engagement with the various teeth T of the ratchet wheel 15. This is the preferred positioning of the ratchet wheel 23 during normal usage of the portable winch, since while the handle lever may be manipulated and pivoted upwardly for effecting a turning of the ratchet wheel through the pressure exerted and transmitted by means of the ratchet pawl 23, it is necessary that the pawl shall remain in engagement with said teeth T. Likewise, as the handle lever L is pivoted downwardly, as for a resetting in preparation for a further drum turning, the extending portion 25 of the ratchet pawl 23 will simply override, against the pressure of its spring 27, the various teeth T of the ratchet wheel 15, as shown in action in FIG. 5. In addition, the extending stem-like portion 29*a* of the torsion spring 27 can be pivoted downwardly and beneath, or to the opposite side, of the boss means 30. When this is effected, the torsion spring 27 has a tendency to lift the ratchet pawl 23, and sustain it permanently out of engagement with the various teeth T of the ratchet wheel 15. When in this position, the handle lever L, while pivoted upwardly, or downwardly, has no effect upon the ratchet wheel 15, and does not effect its turning, except under that condition which will be subsequently described as when the ratchet pawl 23 comes into contact with the stop pawl mechanism 26. It might be stated, though, that when the extending portion 29 of the torsion spring is arranged at the opposite side of the boss means 30, it undertakes the position as shown in FIGS. 6 and 7, and sustains an outward dispostion of the ratchet pawl 23, clear of the teeth T of the ratchet wheel 15, except under those conditions when it enters into engagement with the stop pawl 26, in the manner as shown in FIG. 7**, and which will be subsequently defined.

As can be noted in the various figures, the stop pawl 26 is fabricated of various components which normally tend to effect its engagement with the teeth T of the ratchet wheel 15, in order to prevent its back turning, or unwinding of cable 4 from the drum 6. The stop pawl includes a detent portion 32, having a frontal edge, as at 33, which is normally disposed for engagement with one of the teeth T of the ratchet wheel 15, generally at all times during the hold of this cable. In order to reinforce the stop pawl at this location, it is formed as an angle member, having an upright flange portion 34 as can be seen. Extending upwardly from the detent portion 32 of the stop pawl are a pair of flanges, as at 35 and 36, the former of which is formed integrally with the upright flange portion 34 of the pawl. The flanges are spaced apart a fixed distance, as can be seen. Each flange has an aligned aperture, as at 37, provided therethrough, and extending through each flange aperture is the second shaft 38 that is arranged between the side frames 8 and 9 of the frame member 1. Actually, this shaft 38 may undertake a bolt and nut combination, and have a sleeve **38*a* thereon, as can be seen. Extending rearwardly from the detent portion 32 of the stop pawl 26 is a release means 39, which actually comprises an integral stem extending reasonably clear of the frame member 1 in order to provide a convenient location where the operator may press upon said stem, as required, in order to release the stop pawl 26 from engagement with any teeth T of the ratchet wheel 15. This is generally performed when it is desired to provide for a very rapid unwinding of the cable 4, under the weight of its supported load, from the drum means 6. In order to continuously bias the stop pawl 26 into engagement with the ratchet wheel teeth, there is provided a spring 40 which is fixed, at one end, against the side frame 9, by means of the holder 41, while its other end 42 is bent for disposition under the detent portion 32, of the stop pawl, and fixed thereatso as to continuously bias it upwardly, into engagement with ratchet wheel 15, as can be seen in FIG. 3**.

Also mounting upon the shaft 38, but intermediate the two flange portions 35 and 36 of the stop pawl 26, is a release cam 43, and which is generally in alignment for engagement by the ratchet pawl 23, when it is desired to provide an incremental release, one tooth at a time, of the cable from the winding drum 6, as through the manipulations as shown in FIGS. 6 and 7. This release cam 43 is formed generally as a bent metal plate, providing a pair of extending cam plates 44 and 45, which are bent having an intermediate and arcuate or bearing portion 46 which is designed for snapping onto the shaft 38, as noted. Thus, the distance of the bight portion between the cam plates 44 and 45 is intentionaly designed to be slightly smaller than the diameter of the shaft 38, so that once the release cam is snapped into position upon the said shaft 38, it will remain thereon, but be reasonably free for pivot with respect thereto. Stop means 47 are provided upon the flange portions 35 and 36, in order to function as a keeper to limit the degree of pivot of the release cam 43 upon the said shaft 38. But, as can be noted, as the ratchet pawl 23 is pivoted in conjunction with the upward movement of the handle lever L to its fullest extent, as shown in FIGS. 6 and 7, it has a tendency to bias against the surface of the upper disclosed cam plate 44, and urge it and its integral plate 45 downwardly, against the detent portion 32 of the stop pawl 26, and urge it against the bias of its spring 40, to become disengaged from the teeth of the ratchet wheel 15, as can be be noted in phantom line drawing, as disclosed in FIG. 7.

The operations of this portable winch, particularly through the cooperative efforts of its especially designed ratchet pawl 23, in addition to the specifically structured stop pawl 26, are as follows. As can be seen particularly in FIG. 3, and as previously briefly alluded to, during normal operations of the portable winch, its upper hook 2 will be suspended or hooked onto some stablized component, whether it be a roof truss, as when it is desired to lift a load, or perhaps suspend it from the limb of a tree, such as when it may be employed by the hunter for lifting a deer, or other bagged heavy animal, in preparation for dressing, or whether it be connected to the trunk of a tree, or some other stabilizing structure, as when it is desired to pull a heavy load horizontally along a surface, such as, for example, should a vehicle be stuck in a ravine, and require removal. These are just isolated examples of how the portable winch can be used, to show the versatility of its application. But, as can be noted in FIG. 3, the ratchet stem 23 has its spring means 27, and more specifically the extending portion 29 arranged above its boss means 30, which effectively constantly urges its extending portion 25 into engagement with the teeth T of the ratchet wheel 15. Likewise, at this time, the stop pawl 26, and more specifically its frontal edge 33, will be in permanent engagement with the teeth T of the ratchet wheel 15. This is a standard operation for any prior art winch device. As the handle lever L is raised upwardly, as shown in FIG. 1, its ratchet pawl 23 forces a turn of the ratchet wheel by means of mechanical action for pulling of the cable 4, and winding directly upon the drum 6, in order to lift or pull its suspended load. Obviously, the load will have been hooked onto the hook means 5. When the handle lever L reaches its upper limit of pivot, the stop pawl 26 remains in engagement with the proximate tooth T of the ratchet wheel, fixing the drum 6 in its wound position, while the handle lever L may be repivoted downwardly in preparation for another lift. This action is shown in FIGS. 3 and 5. This continues until such time as the load is fully moved to that position as required or desired.

On the other hand, should it be desired to provide for a rapid release of the load, then the ratchet pawl 23 will be moved from engagement with the teeth of the ratchet wheel 15, and this achieved simply by pulling upon the extended portion **29*a* of the torsion spring 27, until such time as its extension 31 moves to an opposite side or edge of the boss 30, as shown in FIGS. 6 and 7, at which time the extended portion 25 of the ratchet pawl 23 moves from engagement with the teeth T. Hence, the ratchet pawl 23 then will be free and clear of the ratchet wheel 15, and have no effect upon it, regardless of whether it is being pivoted upwardly or downwardly. At this time, the operator may simply push upon the stem portion 39 of the stop pawl 26, in order to release its detent portion 32 from the teeth T of the ratchet wheel 15, and once its leading edge 33 clears that tooth proximate with it, the cable wound drum 6 is free for rapid turning, for unwinding of its cable 4 and a release of its suspended load, either until it hits the ground, or perhaps settles to a stabilizing position. This can be easily understood upon reviewing the various figures of the drawings. If the operator has difficulty in releasing the stop pawl 26 from its engaged tooth T, and exerting pressure upon the stem 39 is not sufficient to attain such release, then he can simply pivot the handle lever L upwardly, to its fullest extent, until such time as its ratchet pawl 23 engages release cam 43, to release and free the stop pawl 26 from the gear teeth T, in the manner as shown in FIGS. 6 and 7, in order to retain a clearance of that stop pawl 26 from the ratchet wheel, holding or forcing the stem 39 to maintain that disengagement of the stop pawl from the ratchet wheel 15, a simple backturning the handle lever L to a limited degree, the ratchet wheel 15 will become totally clear of both the stop pawl 26, and ratchet pawl 23, and allow for a rapid unwinding of the cable 4 from the winding drum 6**. This also can be understood upon viewing the drawings.

On the other hand, should it be desired to provide for an incremental unwinding of the drum 6, in order that any laod may be eased from its suspended or held position, and not just simply dropped to a location, the handle lever L, or more specifically its ratchet pawl 23, will be manipulated into the position shown in FIG. 6. This is achieved, once again, by urging the extending portion **29*a* and the segment 31 of the torsion spring 27 to the opposite side of the boss means 30, from that location as shown in FIG. 3. Under this arrangement the ratchet pawl 23 will be maintained out of engagement with its ratchet wheel 15, as noted in said FIG. 6. But, while the handle lever L is pivoted fully upwardly, as for example as shown in FIG. 6, assuming that the portable winch is suspended vertically, in the manner as shown in FIG. 1, the pawl 23 eventually comes into contact with the release cam 43 of the stop pawl 26. When this occurs, that extending portion 25 of the ratchet pawl contacts the cam plate 44, biasing it downwardly, against its keeper 47, while simultaneously forcing the other cam plate 45 against the detent portion 32 of the said stop pawl 26. Further upward shifting of the handle lever L causes it to move from that position as noted in FIG. 6, to the location as disclosed in FIG. 7, until such time as the front of the extending portion 25 of the ratchet pawl 23 contacts one of the tooth T of the ratchet wheel 15, and a further slight shifting thereof frees the leading edge 33 of the stop pawl 26 to clear its contiguous tooth T of the ratchet wheel. It is the pressure exerted upon the release cam 43, by means of the ratchet pawl 23, that forces the stop pawl 26 to pivot clear of the ratchet wheel teeth. But, as the handle lever L is reversed in its pivot, or begins to move downwardly, under both the force of movement exerted by the hand of the operator upon the handle lever L, in addition to that load weight exerted upon the cable 4, and hence upon the drum 6, the combined ratchet pawl 23 and wheel 15 commences to unwind or into a reverse pivot, and as this maneuver is transpiring, the said ratchet pawl gradually releases its bind upon the release cam 43, until such time as it clears the same, with the stop pawl 26 then re-entering into engagement with the next tooth T of the ratchet wheel 15. Thus, as can be seen, the drum 6 will be allowed under that circumstance to release cable equivalent to the movement of the drum by one tooth of the ratchet wheel 15, and as the handle lever L is continuously shoved upwardly, repeatedly into engagement with the releas cam 43, and then released, the ratchet wheel will be allowed to turn one tooth at a time, in cooperation with the operations of the leading edge 33 of the stop pawl 26, thereby providing a continuous incremental release of any load that may be suspended by the hook means 5** of the portable winch.

Thus, as can be readily understood, it is the cooperative action between the ratchet pawl 23, the various mechanisms associated with the stop pawl 26, in conjunction with the ratchet wheel 15, and its various gear teeth, that provides for the incremental lowering or release of any load suspended or held by the designed winch of this invention.

Variations or modifications to the subject matter of this invention may occur to those skilled in the art upon reviewing the disclosure herein. Such variations, if within the spirit of this invention, are intended to be encompassed within the scope of any claims to patent protection issuing hereon. The description of the preferred embodiment set forth herein is done so for illustrative purposes only.

Having thus described the invention what is claimed and desired to be secured by Letters Patent is:

1. In a portable winch incorporating a ratchet-wheel-pawl assembly and for use in pulling or lifting a connected load, said assembly including a frame member incorporating an axle and supporting a drum containing a supply of wound cable, a ratchet wheel integral with and carried by the drum, a handle lever pivotally mounted to the axle and incorporating a ratchet pawl that normally is maintained in engagement with the ratchet wheel for forcing drum rotation when the lever is turned in one direction, and overriding the ratchet wheel when turned in the opposite direction, and a stop pawl supported by the frame member for engagement with the ratchet wheel to prevent its return as cable is being wound under force upon said drum, the improvement which comprises, a spring means operatively associated with the ratchet pawl and provided for normally biasing said pawl engagement with the ratchet wheel, and said spring means being shiftable for disengaging said ratchet pawl from the said ratchet wheel, said spring means consisting of a single torsion spring, said handle lever at its frame member end bifurcating into a pair of arms, a shaft mounting between said arms, said ratchet pawl pivotally mounting upon said shaft and arranged proximate one of said arms, the torsion spring arranged upon said shaft and at one end fixed to the ratchet pawl, and at its other integral end being held secured but shiftable by pivoting between at least two positions with respect to the other handle lever arm, a boss means provided upon the other lever arm and useful for fixing the torsion spring end in the two said positions, said spring having an extended portion integral with said end, and said extended portion capable of being shifted by pivoting to one location adjacent the boss means for maintaining said ratchet pawl in engagement with the ratchet wheel, and said extended portion of the spring capable of being shifted by pivoting to an opposite location adjacent the boss means, and thereby shifting said ratchet pawl out of engagement with the ratchet wheel.

2. In a portable winch incorporating a ratchet-wheel-pawl assembly and for use in pulling or lifting a connected load, said assembly including a frame member incorporating an axle and supporting a drum containing a supply of wound cable, a ratchet wheel integral with and carried by the drum, a handle lever pivotally mounted to the axle and incorporating a ratchet pawl that normally is maintained in engagement with the ratchet wheel for forcing drum rotation when the lever is turned in one direction, while overriding the ratchet wheel when turned in the opposite direction, and a stop pawl supported by the frame member for engagement with the ratchet wheel to prevent its return as cable is being wound under force upon said drum, the improvement which comprises, spring means operatively associated with the ratchet pawl and provided for normally biasing said pawl into engagement with the ratchet wheel, and said spring means being shiftable by pivoting for disengaging said ratchet pawl from the said ratchet wheel, said spring means comprising a torsion spring, said stop pawl incorporating another spring means, said another spring means normally biasing said stop pawl into engagement with the ratchet wheel to prevent its unwinding of cable after the drum has been rotated in one direction for winding cable thereon, and release means operatively associated with the stop pawl and which upon actuation disengaging the said pawl from the ratchet wheel to effect unwinding of the cable from said drum, said release means comprising an integral stem extending from the stop pawl, a pair of spaced apart side frames forming the frame member, a shaft mounted between said side frames, said stop pawl and spring means mounted upon said shaft, said ratchet pawl when disengaged from the ratchet wheel capable of repeat contacting with said stop pawl to provide an incremental unwinding of cable from the drum, a separate release cam operatively associated with the said stop pawl and aligned for contact by the said ratchet pawl to provide an incremental unwinding of cable from the said drum, said release cam also mounted for pivotal movement relative to the stop pawl upon said shaft, said stop pawl including a detent portion, said detent portion normally in engagement with said ratchet wheel, a pair of flange portions integrally connected at an aproximate ninety degree angle at each side of the detent portion, each flange portion having an aperture therethrough and through which the shaft inserts, said flange portions being spaced apart, said release cam being mounted upon said shaft and arranged between said flange portions, said release means comprising an integral stem extending from said detent portion, whereby said handle lever and ratchet pawl upon reaching a limit of its pivot in one direction providing for contact of said ratchet pawl against the separate release cam and urging it against said detent portion to a temporarily disengage said stop pawl from said ratchet wheel and thereby providing an incremental unwinding of cable from the winch drum, a keeper means provided upon one of said flange portions to limit the pivotal movement of said release cam, said release cam comprising a shaped plate formed into a pair of integrally extending plate cams, said shaft fixedly held for pivotal movement of said release cam between said extending detent portion flanges, one of said extending cam plates disposed for contact with the detent portion of said stop pawl, while the other extending cam plate aligned for contact by the ratchet pawl, and said pair of integrally extending cam plates being angularly disposed with respect to each other.

* * * * *